United States Patent [19]

Karaki et al.

[11] Patent Number: 4,795,496

[45] Date of Patent: Jan. 3, 1989

[54] METHOD OF REMOVING ADHERENT FOREIGN MATTER FROM WORK PIECES

[75] Inventors: Shintaro Karaki; Yoshikazu Chigodo; Masaaki Okane; Yukio Tanaka, all of Nagaokakyo, Japan

[73] Assignee: Murata Manufacturing Co., Ltd., Japan

[21] Appl. No.: 823,587

[22] Filed: Jan. 29, 1986

[30] Foreign Application Priority Data

Jan. 31, 1985 [JP] Japan ..... 60-18338

[51] Int. Cl.[4] ..... B08B 9/04

[52] U.S. Cl. ..... 134/8; 134/22.1; 134/22.11; 134/25.1; 134/37; 51/302; 51/320; 51/313; 422/209; 422/210

[58] Field of Search ..... 134/22.11, 22.1, 25.1, 134/37, 5, 6, 7, 8; 51/302, 320, 22, 56, 313; 422/209, 210

[56] References Cited

U.S. PATENT DOCUMENTS

| | | | |
|---|---|---|---|
| 1,121,308 | 12/1914 | Thomas | 134/22.11 |
| 3,680,266 | 8/1972 | Shiplov | 51/313 |
| 3,848,373 | 11/1974 | Pletscher | 51/313 |
| 3,939,613 | 2/1976 | Ayers | 51/320 |
| 4,499,692 | 2/1985 | Balz | 51/313 |

*Primary Examiner*—H. M. S. Sneed
*Assistant Examiner*—Sharon T. Cohen
*Attorney, Agent, or Firm*—Ostrolenk, Faber, Gerb & Soffen

[57] ABSTRACT

Adherent foreign matters such as metal powders and sludges are removed from the surface of work pieces of metal, ceramics or the like in a treating process thereof. Work pieces where foreign matters adhere and a granules composed of a heat-resisting inorganic substance such as sand are put together into a container. The inside of the container is heated to raise the temperature to the melting point of the adherents or to a temperature near it, and an external force is applied; to the container so that the work pieces will move in the container, for example, to rotate the container.

10 Claims, 1 Drawing Sheet

METHOD OF REMOVING ADHERENT FOREIGN MATTER FROM WORK PIECES

BACKGROUND OF THE INVENTION

1. Field of the Invention

The present invention relates to a method of removing adherent foreign matter from work pieces. More specifically, the present invention relates to a method of removing adhering foreign matter such as metal powders, sludges on the surfaces of work pieces of metal, ceramics or the like in a treating process thereof.

2. Description of the Prior Art

FIG. 2 is a perspective view of a work piece whereto metallic matter adheres. In a process of treating work pieces 1 such as fired ceramic material, metal, semiconductor devices, hybrid integrated circuits or the like, sludges (adhering metallic matter) 2 such as metal oxides, carbides and the like adhered to the surfaces thereof. Then, it is necessary to remove the sludges 2 adhering to the surface of the work pieces 1. Conventionally, the following two methods are known to be employable as the removing method.

A first method is employed in the case of a metal of a low melting point in which the melting point of the sludge 2 is 300° C. or lower. In this method, oil is heated to a temperature higher than the melting point of the sludges (for example, 330° C.), and the work pieces are immersed therein and agitated or swayed. This method utilizes melting of the sludges 2 on the surfaces of the work pieces 1 immersed in the oil due to the high temperature of the oil.

A second method is employed for sludges having a high melting point exceeding 300° C., wherein the sludges 2 are removed by the sandblasting method or scraped off by sand paper, knife or the like.

In the above-described first method, the oil adhering to the work pieces is required to be washed off, and therefore this method has a problem of requiring another process for removing the oil.

In the above-described second method, large flaws due to injuries caused by the removing method are likely to occur on the surface of the work pieces 1, and therefore the method has a problem of producing local defects. Also, it has another problem of lacking mass-production feasibility since the sludges 2 have to be scraped off while the work pieces 1 are fixed by a jig or the like.

SUMMARY OF THE INVENTION

Therefore, a principle object of the present invention is to provide a method of removing adhering matter which can remove adherent foreign matter from work pieces by a sample process without producing local defects on the surfaces of the work pieces.

The present invention, in brief, relates to a method of removing adherent foreign matter from work pieces wherein a heat-resisting container and granules composed of a heat-resisting inorganic substance are prepared, work pieces and the granules are put together into this container, the inside of the container is heated to raise the temperature thereof to the melting point of the adhering matter or to a temperature near it, and an external force is applied to the container so that the work pieces will be moved in the container.

When the adherent foreign matter on the work pieces is heated, it melts or softens to become easily separable from the surfaces of the work pieces. Then, when an external force is applied to the container, the granules are brought in sliding contact with the surfaces of the work pieces, whereby the adhering foreign matter is removed from the work pieces.

In accordance with the present invention, the adherent foreign matter on the work pieces can be removed easily and reliably. Then, no additional process is required for removing the oil in comparison with the conventional first method, and also in comparison with the conventional second method, and also in comparison with the conventional second method, no large injuries are caused on the surface of the work pieces, and therefore an effect of preventing the work pieces from having local defects can be expected. Furthermore, the present invention is applicable irrespective of whether the melting point of the adherent foreign matter on the work pieces is high or low.

These objects and other objects, features, aspects and advantages of the present invention will become more apparent from the following detailed description of an embodiment of the present invention when considered in conjunction with the accompanying drawings.

DESCRIPTION OF PREFERRED EMBODIMENTS

Figure 1:
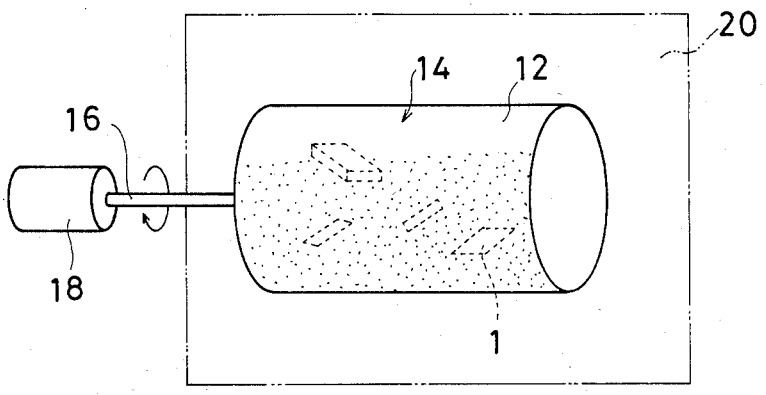
FIG. 1 is a schematic view showing a method of removing metallic adherent foreign matter on work pieces of one embodiment of a method in accordance with the present invention.
Figure 2:
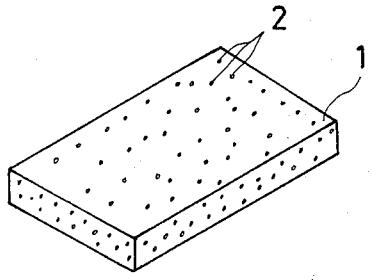
FIG. 2 is a perspective view of a work piece whereto metallic foreign matter adheres.

FIG. 1 is a view showing a method of removing adherent foreign matter from work pieces in accordance with the present invention. First, a container 12 made of a metal or a ceramic having a high mechanical strength is prepared. The container 12 also has heat-resisting properties. Fired small ceramic pieces 1, as one example of work pieces, and granules or sand 14 as a material for removing adherent foreign matter from the work pieces 14, are put in this container, for example, in a ratio in volume of about 1:1 to 1:2. As an example of this small ceramic piece 1, an electronic component is cited, at two ends of which electrodes are provided. The granules 14 are composed of a material which has a heat-resisting property and contains no harmful substance, for an example of which $SiO_2$ or $ZrO_2$ can be suggested. Such a material is preferable particularly in the case where the work piece 1 is a ceramic electronic component. Grain size of the granules 14 is preferably smaller than that of the work pieces, and further a material which can be separated simply by passing through a sieve or the like after cleaning is selected. For the particle diameter, 2 mm or less is preferable to prevent the work pieces 1 from being damaged by chipping or other flaws. In experiments, sand was used as the granules 14, and the average particle diameter was, for example, 0.05–1.0 mm.

Then, the container 12 is connected to a motor 18 through a connecting shaft 16 to be given an external force. This container 12 is put in a high temperature tank 20 to be heated so that at least the inner temperature of the container will be raised to the melting point of the sludges 2 or to a temperature near it. A higher temperature in the high-temperature rank 20, that is a higher atmospheric temperature of container 12 can achieve a greater removing effect as long as it has no adverse effect on the work pieces 1.

Preferably, the container 12 is rotated by a rotating force of the motor 18 while the container 12 is heated in the high-temperature tank 20, and thereby an external force is applied to move the work pieces 1 in the container 12. The number of revolutions in this case is selected, for example at 30–100 rpm and preferably at about 60 rpm. This is because the work pieces 1 rotate together if the number of revolutions is excessively large.

As described above, when the container 12 is heated in the high-temperature tank 20, the sludges 2 adhering to the surfaces of the work pieces 1 melt or soften, becoming easily separable. The work pieces 1 move in the container 12 due to application of the external force to the container 12, and the granules 14 are brought into sliding contact with the surfaces at that time, whereby the sludges 2 are removed easily from the work pieces 1. Also, in the case where the work pieces 1 are adhered to one another by the sludges 2, each work piece 1 becomes easily separable by melting or softening of the sludges 2, and no difficulty takes place in removing the sludges 2.

Although the time required for heating the container 12 and applying the external force depends upon the heat capacities of the container 12, the granules or sand 14 and the work pieces 1, a time of 1–10 minutes is sufficient after a certain atmospheric temperature (the melting point of the adhering matter or a temperature near it) is reached for that purpose. In the experiments, the sludges 2 could be removed completely in about five minutes in the case where the work pieces 1 were electronic components containing ceramic material. Then, it was made sure that no electronic components themselves were affected adversely.

In addition, in order to prevent the work piece 1 from being oxidized during heating or moving thereof, $N_2$ gas or $CO_2$ gas may be injected into the container 12.

After the sludges 2 are removed as described above, the work pieces 1 or the granules 14 are taken out of the container 12 and have only to be separated by a sieve or the like. In addition, in the case where granules small particles adhere to the surface of the work piece 1, they can be removed easily by cleaning in water (for example, ultrasonic cleaning).

Now, in the above-described embodiment, the case is described where the container 12 is rotated by using the motor 18 as a means for applying the external force to the container 12, but the container 12 may be vibrated or swayed as another means.

Also, the above-described embodiment shows the case where the work pieces and the granules are put together directly in the container, but a method is also possible wherein only the work pieces are put, for example, in a separate net basket and this basket is put in the container. The net basket in this case, needless to say, should be one which allows the granules to get in or out through said basket.

Furthermore, the present invention is outstandingly effective in the case where the adhering foreign matter is metal. However, the present invention is well applicable in case of other materials than metal, for example, resin.

Although an embodiment of the present invention has been described and illustrated in detail, it is clearly understood that the same is by way of illustration and example only and is not to be taken by way of limitation, the spirit and scope of the present invention being limited only by the appended claims.

What is claimed is:

1. A method of removing adherent foreign matter from work pieces, comprising the steps of:

(a) preparing a heat-resisting container, (b) preparing granules composed of a heat-resisting inorganic substance, (c) putting said work pieces to which foreign matter is adhered, together with said granules, into said container, (d) applying external heat to at least the inside of said container to raise the temperature thereof and the temperature of said work pieces at least to a softening temperature of said adhering foreign matter, (e) applying an external force to said container to move said work pieces and said granules within said container, (f) taking said work pieces out of said container, and (g) taking said granules, to which said foreign matter removed from said work pieces is adhered, out of said container.

2. A method in accordance with claim 1, wherein step (d) further comprises:

predetermining a softening temperature of said adhering foreign matter, and applying external heat to at least the inside of said container to raise the temperature thereof and of said work pieces at least to said predetermined softening temperature.

3. A method in accordance with claim 1, further comprising (h) cleaning said work pieces after removal from said container.

4. A method in accordance with claim 1, wherein said granules and said work pieces are put in said container in step (c) in a volume ratio of 1:1–2:1.

5. A method in accordance with claim 1, further comprising (i) injecting an inert gas into said container.

6. A method in accordance with claim 1, wherein step (e) includes a step of rotating said container to apply said external force to said container.

7. A method in accordance with claim 1, wherein step (e) includes a step of vibrating or swaying said container to apply said external force to said container.

8. A method of removing adherent foreign matter from work pieces, comprising the steps of:

preparing granules composed of a heat-resisting substance;

placing said work pieces to which foreign matter is adhering, together with said granules, into a container;

applying external heat to the container to raise the temperature of said work pieces and granules at least to a softening temperature of said adhering foreign matter; and applying an external force to said container to move said work pieces and granules and thereby remove said softened foreign matter from said work pieces.

9. A method of removing adherent foreign matter from work pieces, comprising the steps of preparing granules of a heat-resisting substance;

placing said work pieces to which foreign matter is adhered into said granules;

applying external heat to said work pieces and said granules to raise the temperature thereof at least to a softening temperature of said adhering foreign matter; and applying an external force to said granules and said work pieces to cause friction therebetween and thereby remove said adhering foreign matter from said work pieces.

10. A method in accordance with claim 9, wherein said heat-resisting granules consist essentially of an inorganic substance.

* * * * *